United States Patent [19]

Wickham et al.

[11] 4,347,881

[45] Sep. 7, 1982

[54] WOOD SPLITTING APPARATUS

[75] Inventors: Ian W. Wickham, Junction Rd., 7.R.D., Inglewood, New Zealand; Maxwell J. Till, New Plymouth, New Zealand; Ernst Forster, Inglewood, New Zealand

[73] Assignee: Ian Wallace Wickham, Inglewood, New Zealand

[21] Appl. No.: 193,115

[22] Filed: Oct. 2, 1980

[30] Foreign Application Priority Data

Oct. 4, 1979 [NZ] New Zealand ..... 191748

[51] Int. Cl.[3] ..... B27L 7/00

[52] U.S. Cl. ..... 144/194

[58] Field of Search ..... 144/193 R, 194

[56] References Cited

U.S. PATENT DOCUMENTS 4,091,851 5/1978 Ober ..... 144/193 R 4,245,683 1/1981 Cedergren ..... 144/193 R

FOREIGN PATENT DOCUMENTS 182212 10/1954 Austria ..... 144/193 R 2462979 3/1981 France ..... 144/194

*Primary Examiner*—W. D. Bray

*Attorney, Agent, or Firm*—Holman & Stern

[57] ABSTRACT

A rotatable threaded cone is secured at the front of a support mounting having a bevelled end which facilitates the passage of a block of wood split by the cone such that large blocks may be split in one operation without the need to withdraw the block to reintroduce the cone into the block at a different place. A platform is pivoted by means of pivot bolt at the end of a support arm to which it is also connected by means of a ratchet assembly and bolts whereby undue pressure on the platform during a block splitting operation will result in the downward pivoting of the platform to thus relieve the pressure on the cone and the drive thereto.

5 Claims, 5 Drawing Figures

WOOD SPLITTING APPARATUS

Figure 1:
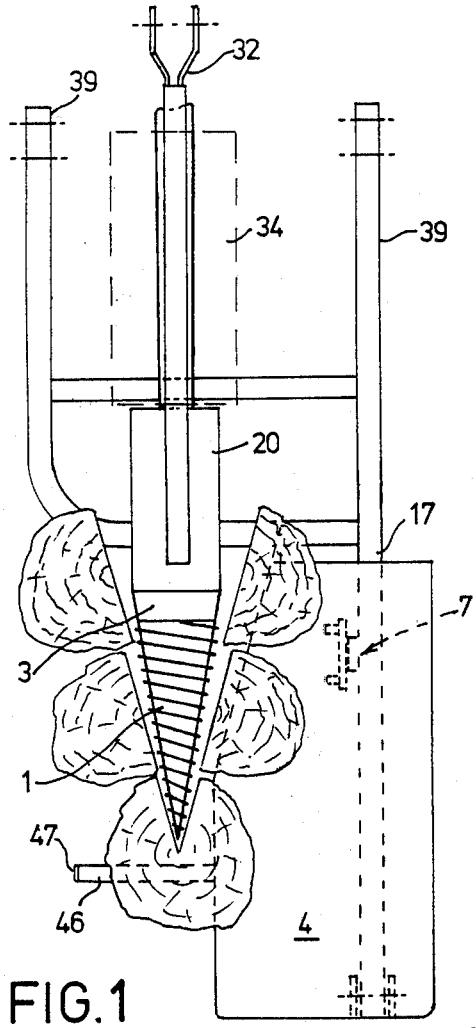

This invention relates to a wood splitting apparatus and more particularly to apparatus for splitting timber blocks.

By engaging a timber block with the apex of a rotated threaded cone the cone will thread into the wooden block splitting same and thus providing firewood in a speedy and efficient manner.

In such apparatus to the present time one disadvantage has been the requirement that a timber block has to be introduced several times onto the rotating cone in order to effect a complete splitting of the block.

It is an object of the present invention to therefore provide wood splitting apparatus of the type above described in which timber blocks even of large size may be split in a single operation without the necessity to withdraw the block to reintroduce the cone into the block in a different place. This also means that new blocks can continue to be fed onto the cone tip as previous blocks, after splitting, are falling to the ground for collection.

According to one embodiment of the present invention there is thus provided apparatus for splitting blocks of wood comprising a rotatable block-splitting threaded cone mounted on a stationary support mounting, a support framework connected with said support mounting, a block-supporting platform positioned below and to one side of said cone, a travel path for a block being split being defined between said cone and said platform and said framework, said travel path, in which the block can move as it is split, extending beyond the support mounting, said support mounting being adapted to accept the pressure tending to restore a split block to its original condition as the split block moves from the base of the cone to said supporting mounting.

In view of such high forces that can be developed on the prime mover due to the wood splitting operation the use of such threaded cones has been somewhat limited; for example if the threaded cone is driven from a tractor PTO then there is a real danger that the PTO could fracture upon too high a stress being developed thereon.

It has been found during testing for example that induced bending stresses of up to 60,000 psi can be developed on a $1\frac{1}{4}''$ drive shaft during a wood splitting operation if a simple anti-rotation support is used, which stresses are clearly not acceptable.

It is therefore an object of one embodiment of the present invention to provide a wood splitting apparatus in which the forces developed as a result of the wood splitting operation being carried out can be maintained at an acceptable level.

According to one embodiment of the present invention there is thus provided a wood splitting apparatus including a wood splitting rotatable threaded cone which has free space around the threaded cone sufficient to enable wood being split to move therewithin during a splitting operation and wherein said apparatus includes means for transferring the pressure tending to restore a split or splitting block to its original condition from the outside edge of the largest diameter of the cone to a stationary block receiving means adapted to receive same from said cone.

Figure 2:
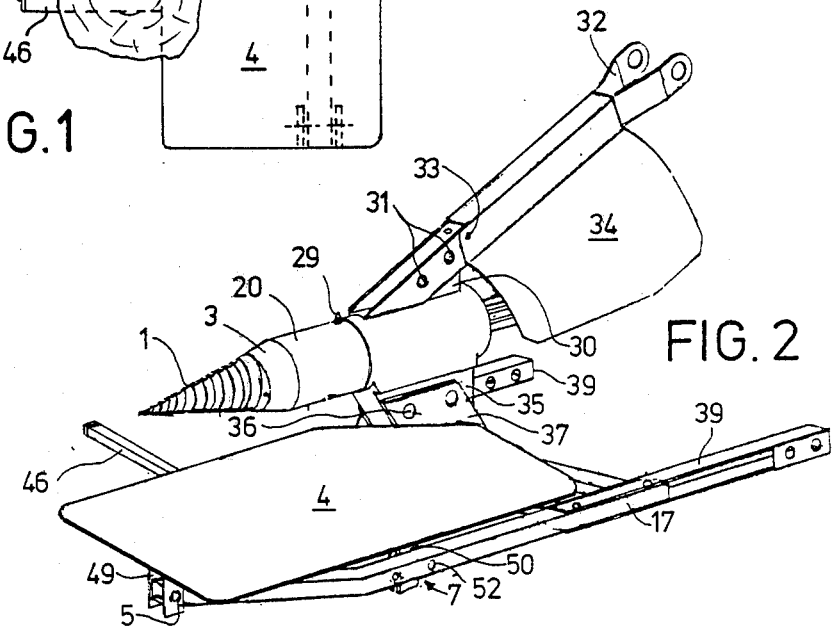
Figure 3:
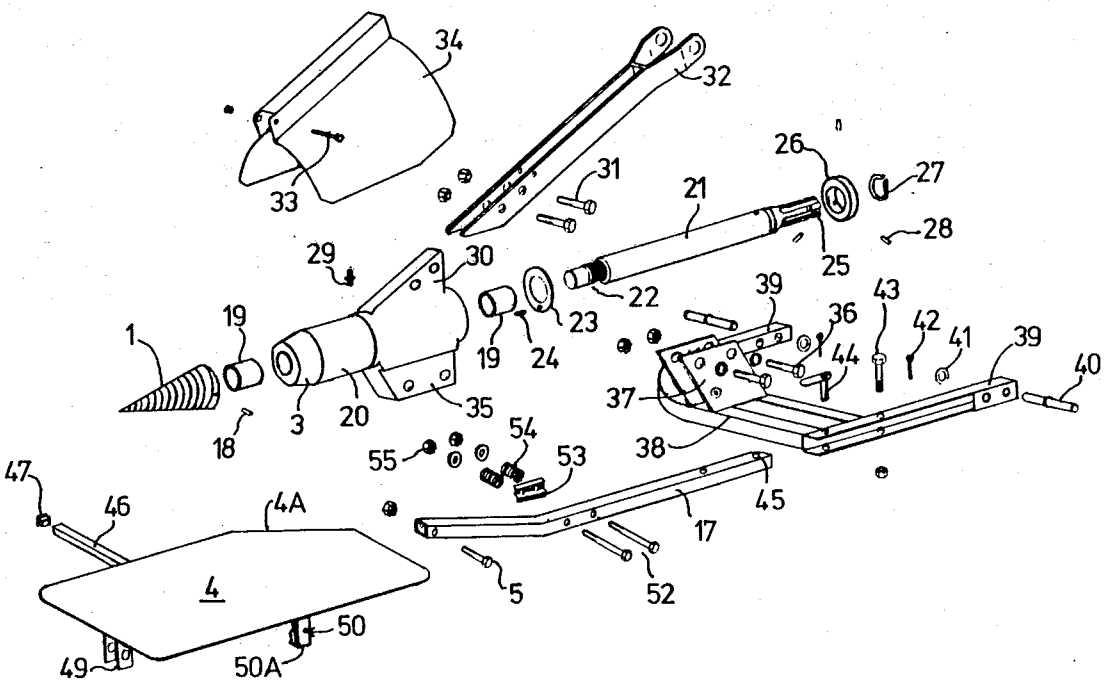
Figure 4:
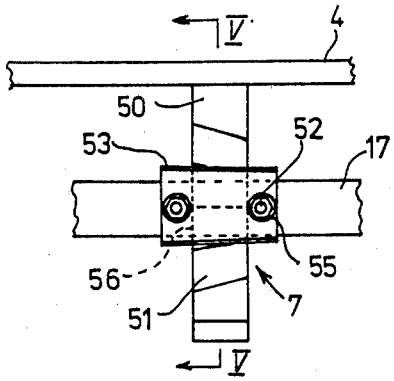
Figure 5:
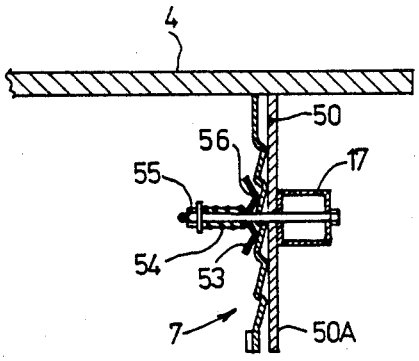

The present invention will now be described with reference to the accompanying drawings wherein;

FIG. 1 shows diagrammatically a plan view of a wood splitting apparatus according to one embodiment of the invention in the course of a wood splitting operation, FIG. 2 shows a side perspective view of the wood splitting apparatus of FIG. 1, FIG. 3 shows an exploded view of the wood splitting apparatus of FIGS. 1 and 2, FIG. 4 shows a front view of the ratchet assembly for use in the embodiment of the preceding Figures, FIG. 5 shows a cross-sectional view along arrows V—V of FIG. 4, Referring to the accompanying drawings a steel cone 1 is provided with a suitable thread, usually left handed for use with tractor PTO's, which is secured by means of a grub screw 18 with the turned-down end 22 of a shaft 21 extending through a pair of main shaft bearings 19 provided within a support mounting 20. A thrust bearing 23 is secured by means of pin 24 to one end of the mounting 20. The drive coupling end of the shaft 21 is shown with splines 25, a shaft collar 26, circlip 27 and collar locking grub screws 28.

A grease nipple 29 is shown provided to enable lubrication of the bearings 19.

Connected with an upstanding web 30 of the mounting 20, by means of bolts 31, is a top link 32. The top link 32 also, by means of a bolt 33, enables the connection thereto of a P.T.O. guard 34.

A downwardly depending web 35 of the mounting 20 is able to be connected by assembly bolts 36 with mounting plates 37 extending upwardly from a main frame 38.

The main frame 38 is seen to include a pair of side arms 39 providing the bottom links for connection with the tractor or such vehicle. This connection is illustrated by means of linkage pins 40, washers 41 and split pins 42.

The outer side arm 39 is seen to be of a channelled configuration into which a support arm 17 can be fitted and secured by means of a pivot bolt 43 and a breakaway pin 44, both of which can be inserted through the side arm 39 and into respective apertures 45 provided through the arm 17.

Connected with the arm 17 is a platform 4.

Extending laterally and outwardly from the platform 4 is a safety arm 46 with a closing plastic bung 47, the safety arm 46 serving to protect against an operator of the apparatus accidentally approaching too close to the tip of the cone 1.

The free end of the arm 17 is shown provided with a pivot bolt 5 to secure the arm 17 with support brackets 49 depending downwardly from beneath the platform 4.

Additionally, and as shown in greater detail in FIGS. 4 and 5, a ratchet assembly 7 provides a releasable connection between the platform 4 and the arm 17. The ratchet assembly 7 is seen to comprise a ratchet arm 50 and support plate 50A secured beneath the platform 4 having a plurality of grooves 51 provided therein which are angled such that the grooves on the top and bottom portions respectively of the ratchet arm 50 converge towards one another and a point nearer the free end of the arm 17. The grooves 51 about the substantially central part of the ratchet arm 50 will however be substantially horizontal so as to be substantially parallel with the plane in which the platform 4 normally lies.

Extending through the arm 17 are shown a pair of bolts 52 connecting with, on an opposite side of the arm 17, a ratchet plate 53 spring biased by means of springs 54 the bias of which can be adjusted by the tightening of the nuts 55.

It will be seen that when the platform is substantially level, lying substantially parallel with the arm 17, the corrugations 56 on the ratchet plate 53 will lie within the substantially horizontal grooves 51 across the ratchet arm 50.

However if the platform 4 pivots about pivot bolt 5 the ratchet plate grooves 56 will engage either the top or bottom portions of the ratchet arm 50 depending on whether the platform 4 has been raised or lowered and due to the inclination of the top and bottom grooves 51 engagement by the corrugations 56 of the ratchet plate 53 is still achieved.

The platform 4 is seen to have a cut-away edge 4A which will generally be at a greater angle than that of the external surface of the cone 1. Thus from the apex to the base of cone 1 a progressively wider path for travel of the block of wood being split is provided about the cone periphery. Also it is seen particularly from FIG. 1 that the block travel path about the cone periphery extends back beyond the base of the cone 1 without any intervening obstruction, for example for some 2 to 3 feet, and as no resistance to movement of the split block by an obstruction is present, consequential pressure on the platform 4 and on the cone 1 is thus avoided.

However, in the event that pressure between the platform 4 and the cone 1 were increased to too high a level, such as in the event of a jam occurring, the platform 4 by means of the ratchet assembly 7 is able to release such pressure overload without in fact requiring any interruption of the splitting process. Thus in the case of difficult wood being split, and dependent on the amount of tightening of the nuts 55 on the springs 54, the ratchet arm 50 may be forced passed the ratchet plate 53 into a new position relative thereto in enabling the front end of the platform 4 to drop.

At the end of that particular splitting operation the platform 4 can be manually raised to its normal position ready for the next block.

The adjustment of the spring bias acting on the ratchet plate 53 will generally be such as to enable a weight of the order of 180 pounds to be supported by the platform 4.

Referring particularly to FIG. 1 of the accompanying drawings the support 20 with its chamfered leading edge 3 is seen to enable a block after splitting to carry on passed the end of the cone 1 in order that the splitting is completed in a single run. In FIG. 1 there are in fact shown three blocks positioned on the platform 4 all at various stages of being split. The bevelled end 3, which is of course stationary, acts so as to accept the loading from the base of the cone 1 as a block which is almost totally split attempts to re-close. This loading is thus transferred from the rotating cone 1 to the stationary surface 3 and in so doing this has been found to increase the efficiency with which the completion of the splitting of the block can be achieved.

In the event that increased access to the cone 1 was required, for example if a large block jammed thereon needed to be cut, the platform 4 is able to be swung back away from the cone 1 merely by the removal of the pin 44.

In use, the linkages 39 and 32 will connect with the three point linkage system of a tractor or such vehicle and the end 25 of the shaft 21 will connect with a suitable coupling arrangement to couple the shaft 21 with the tractor P.T.O. The coupling mechanism may generally have a break-away function such that too high a load on the cone 1 will not be transmitted to the P.T.O. but instead the coupling will automatically disconnect. Various types of torque limiting couplings are known which would be suitable for this purpose.

Where in the aforegoing description reference has been made to specific components or integers of the invention which have known equivalents then such equivalents are herein incorporated as if individually set forth.

Although this invention has been described by way of example and with reference to one possible embodiment thereof it is to be understood that modifications and improvements may be made thereto without departing from the scope of the invention as defined in the appended claims.

We claim:

1. Apparatus for splitting blocks of wood comprising:

a rotatable block-splitting threaded cone mounted on a stationary mounting, framework connected with said mounting for supporting said mounting, a block-supporting platform mounted on said framework and positioned below and to one side of said cone, said cone, said platform and said framework defining a path of travel along which a block of wood can move while being split, said path of travel being unobstructed beyond the stationary mounting, and said mounting including bevel means for transferring the pressure tending to restore a split block to its original condition from said cone to said mounting as the split block moves from the base of the cone to said mounting.

2. The apparatus as set forth in claim 1 wherein said bevel means comprises a bevelled surface located adjacent said cone, said surface separating said cone and said mounting; and said platform defines a cut-away portion, one edge of which increases in angle and distance away from an adjacent edge of said cone from its apex to its base to thereby increase the width of said block travel path.

3. The apparatus as set forth in claim 2 wherein said platform, toward its end nearer said base of said cone, includes means for pivotally supporting said platform at its said end so that said platform can pivot downwardly from a first normal, in use, position to a second pivoted position upon application of a predetermined excess pressure incident thereon, the resultant deflection being proportional to said excess pressure.

4. The apparatus of claim 3 wherein said supporting means comprises a downwardly extending ratchet arm having a plurality of grooves therein engageable by at least one corrugation of a ratchet plate secured to said ratchet arm and adjustably biassed into abutting relationship therewith.

5. The wood-splitting apparatus of claim 4 wherein said grooves on said ratchet arm are disposed at top and bottom portions thereof, and are respectively inclined so as to converge toward one another whereby said abutting relationship can continue even when said platform is, in pivoting, raised or lowered from its said normal position.

* * * * *